US009742116B1

(12) United States Patent
Nishiyama

(10) Patent No.: US 9,742,116 B1
(45) Date of Patent: Aug. 22, 2017

(54) CONNECTOR

(71) Applicant: Yazaki Corporation, Tokyo (JP)

(72) Inventor: Noritaka Nishiyama, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/456,638

(22) Filed: Mar. 13, 2017

(30) Foreign Application Priority Data

Mar. 15, 2016 (JP) ..... 2016-050781

(51) Int. Cl.

| | |
|---|---|
| ***H01R 13/641*** | (2006.01) |
| ***H01R 13/627*** | (2006.01) |
| ***H01R 13/703*** | (2006.01) |
| ***H01R 24/68*** | (2011.01) |
| *H01R 107/00* | (2006.01) |

(52) U.S. Cl.
CPC ..... *H01R 13/641* (2013.01); *H01R 13/6272* (2013.01); *H01R 13/7032* (2013.01); *H01R 24/68* (2013.01); *H01R 2107/00* (2013.01)

(58) Field of Classification Search
CPC ..... H01R 13/641; H01R 13/7032
See application file for complete search history.

(56) References Cited

U.S. PATENT DOCUMENTS 6,065,991 A * 5/2000 Fukuda ..... H01R 13/641 439/352
6,106,321 A * 8/2000 Yoshida ..... H01R 13/6272 439/310
2007/0099496 A1* 5/2007 Shigeta ..... H01R 13/6271 439/557
2009/0035981 A1* 2/2009 Lim ..... H01R 13/4361 439/352
2009/0203248 A1* 8/2009 Matsumura ..... H01R 13/631 439/357
2011/0237133 A1* 9/2011 Dufour ..... H01R 13/447 439/628
2012/0177243 A1* 7/2012 Lee ..... H01R 13/7032 381/384
2013/0210266 A1* 8/2013 Osada ..... H01R 13/6272 439/378

(Continued)

FOREIGN PATENT DOCUMENTS

JP 2012-064461 A 3/2012

*Primary Examiner* — James Harvey
(74) *Attorney, Agent, or Firm* — Sughrue Mion, PLLC

(57) ABSTRACT

A connector includes a male housing having a male beak, a plurality of male terminals, a female housing having a female lock portion climbing over the male beak to be locked to the male beak in a fitted state with the male housing, a plurality of female terminals aligned in the alignment direction in the female housing and connected to the respective male terminals in the fitted state, a CPA member having a CPA lock portion capable of being locked to the female lock portion at a fitting assurance position, and short-circuiting pieces provided in the female housing and short-circuiting the adjacent female terminals in the female housing in a non-fitted state. Contact positions between the female terminals and the short-circuiting pieces and locking positions at which the female terminals are locked in the female housing are different from each other about a fitting direction when viewed therefrom.

3 Claims, 7 Drawing Sheets

(56) References Cited

U.S. PATENT DOCUMENTS

| | | | | |
|---|---|---|---|---|
| 2014/0314477 | A1* | 10/2014 | Hamai | H01R 13/4362<br>403/364 |
| 2016/0204543 | A1* | 7/2016 | Kanda | H01R 13/5829<br>439/470 |
| 2017/0040731 | A1* | 2/2017 | Nishiyama | H01R 13/41 |
| 2017/0125949 | A1* | 5/2017 | Saur | H01R 13/641 |

* cited by examiner

CONNECTOR

CROSS-REFERENCE TO RELATED APPLICATION(S)

The present application claims priority to and incorporates by reference the entire contents of Japanese Patent Application No. 2016-050781 filed in Japan on Mar. 15, 2016.

BACKGROUND OF THE INVENTION

1. Field of the Invention

The present invention relates to a connector.

2. Description of the Related Art

As a conventional connector that is applied to a wire harness and the like, for example, Japanese Patent Application Laid-open No. 2012-064461 discloses an incomplete-fitting prevention connector including a male connector, a female connector, and a connector position assurance member (CPA) as a fitting assurance member that is slidably mounted to the outer side of the female connector. In the incomplete-fitting prevention connector, the male connector includes a male beak and terminals, and the female connector includes a female lock climbing over the male beak, a short-circuiting piece, and a short-circuit cancellation portion. The incomplete-fitting prevention connector is made into a short-circuit state when terminals that are adjacent in an alignment direction are electrically connected to each other with the short-circuiting piece in a non-fitted state between the male connector and the female connector. The incomplete-fitting prevention connector is made into a non-short-circuit state when the short-circuit cancellation portion is inserted into between the short-circuiting piece and the terminals in a fitted state.

The incomplete-fitting prevention connector disclosed in Japanese Patent Application Laid-open No. 2012-064461 includes therein various mechanisms such as a locking mechanism that locks the outer circumferential surfaces of the terminals with lances for holding the terminals in the male connector and a short circuit mechanism that short-circuits the outer circumferential surfaces of the adjacent terminals with the short-circuiting piece for making the adjacent terminals into the short-circuit state in the non-fitted state. The connector including the CPA member has a room for improvement in the arrangement of the various mechanisms in the connector, that is, a positional relation among the various mechanisms because the CPA member is provided so as to cover the outer side of the female connector and the size of the connector is therefore larger than the connector provided with no CPA member.

Furthermore, there is a room for improvement in the positional relation among the various mechanisms for a correspondence relation to the outer circumferential surfaces of the terminals in order to cause the various mechanisms to sufficiently exert their functions.

SUMMARY OF THE INVENTION

The present invention has been made in view of the above-mentioned circumferences and an object thereof is to provide a connector capable of making a positional relation among various mechanisms appropriate.

In order to achieve the above mentioned object, a connector according to one aspect of the present invention includes a first housing including a first locking portion, the first locking portion being formed so as to project from an outer surface of the first housing; a plurality of first terminals aligned in an alignment direction in the first housing; a second housing including a second locking portion, the second locking portion being configured to climb over the first locking portion to be locked to the first locking portion in a fitted state in which the second housing is fitted to the first housing; a plurality of second terminals aligned in the alignment direction in the second housing, the second terminals being connected to the respective first terminals in the fitted state; a fitting detection member includes a third locking portion and is configured to be assembled to the second housing and be allowed to move to a fitting assurance position from an initial position in a state in which the second locking portion is locked to the first locking portion, the third locking portion being configured to climb over the first locking portion and the second locking portion locked to the first locking portion in order with movement to the fitting assurance position from the initial position to be locked to the second locking portion at the fitting assurance position; and a short-circuiting piece that is provided in one target housing out of the first housing and the second housing and configured to short-circuit adjacent target terminals in the one target housing in a non-fitted state in which the first housing and the second housing are not fitted to each other, wherein contact positions between the target terminals and the short-circuiting piece and locking positions at which the target terminals are locked in the target housing are different from each other about a fitting direction between the first housing and the second housing when viewed from the fitting direction.

According to another aspect of the present invention, in the connector, it is preferable that the target terminals have a plurality of outer circumferential surfaces when viewed from the fitting direction, and the contact positions and the locking positions are located on different surfaces out of the plurality of outer circumferential surfaces.

According to still another aspect of the present invention, in the connector, it is preferable that the target terminals are formed into rectangular shapes when viewed from the fitting direction, the outer circumferential surface on which the locking positions are located is one of the outer circumferential surfaces of shorter sides opposing each other in the alignment direction, and the outer circumferential surface on which the contact positions are located is one of the outer circumferential surfaces of longer sides opposing each other in an up-down direction orthogonal to the alignment direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment according to the present invention will be described in detail with reference to the drawings. It should be noted that the embodiment does not limit the present invention. Components in the following embodiment include those that can be replaced and easily provided by those skilled in the art or substantially the same components.

Embodiment

Figure 1:
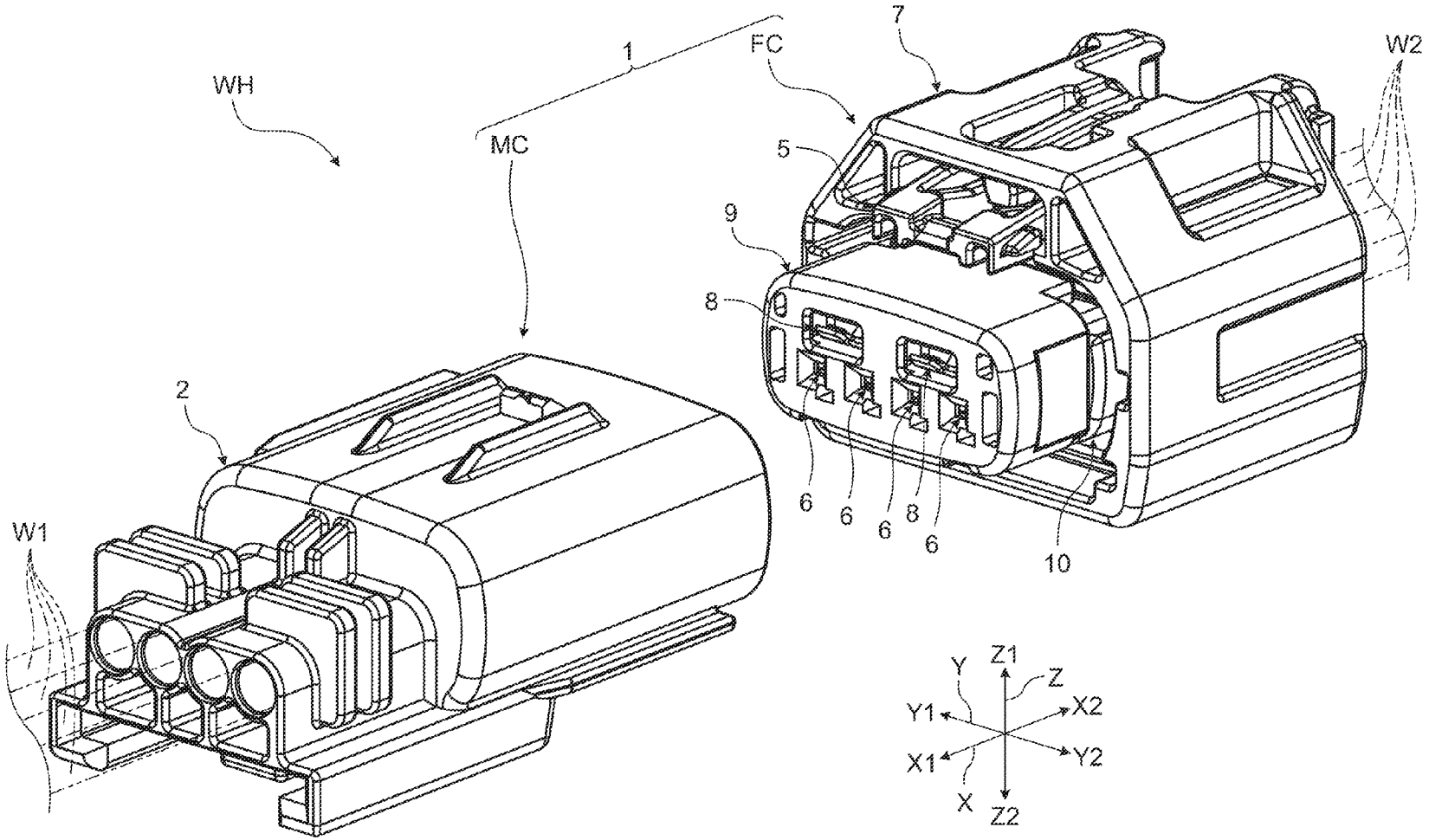
FIG. 1 is an exploded perspective view of a connector according to an embodiment.
Figure 2:
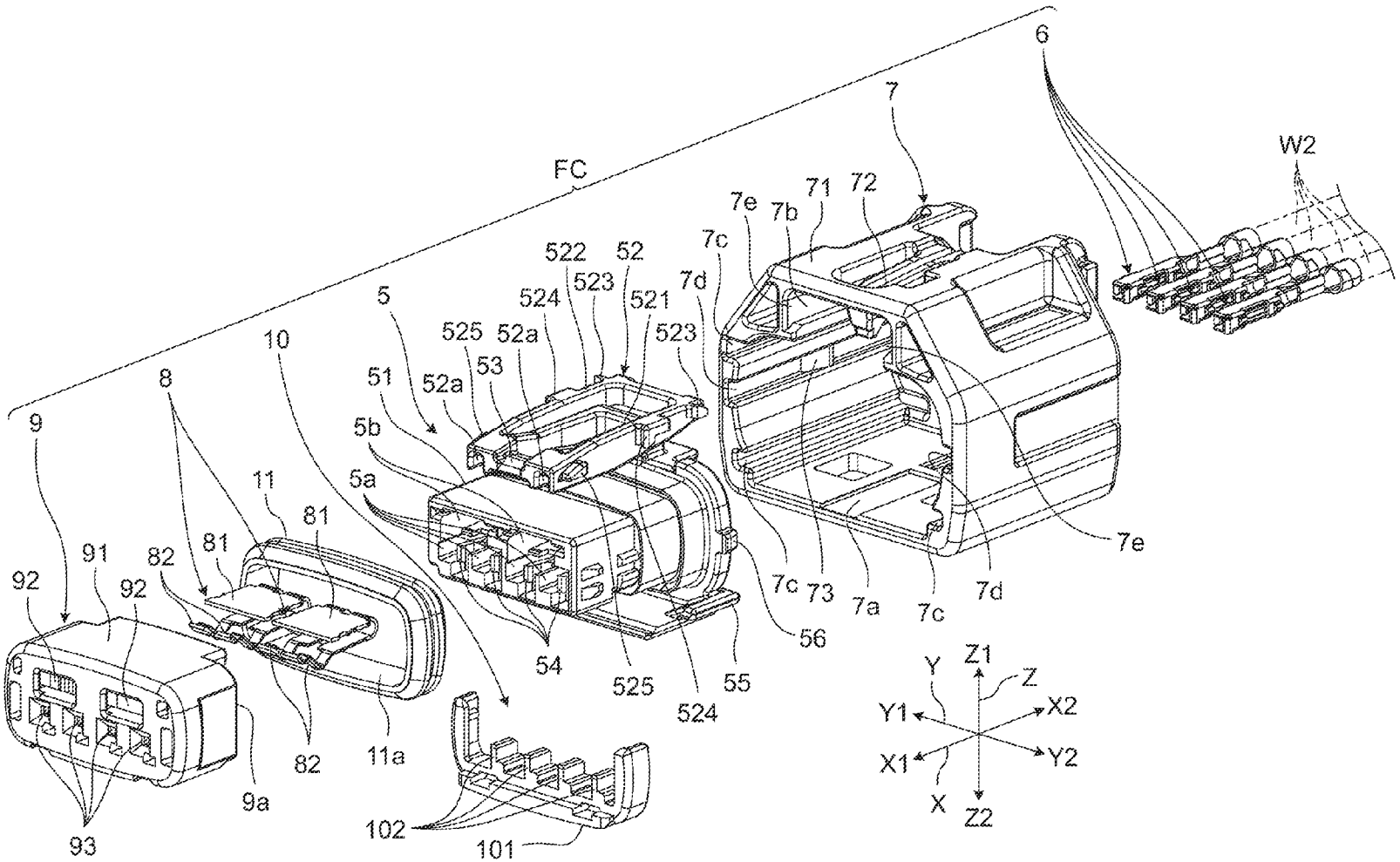
FIG. 2 is an exploded perspective view of a female connector in the connector in the embodiment.
Figure 3:
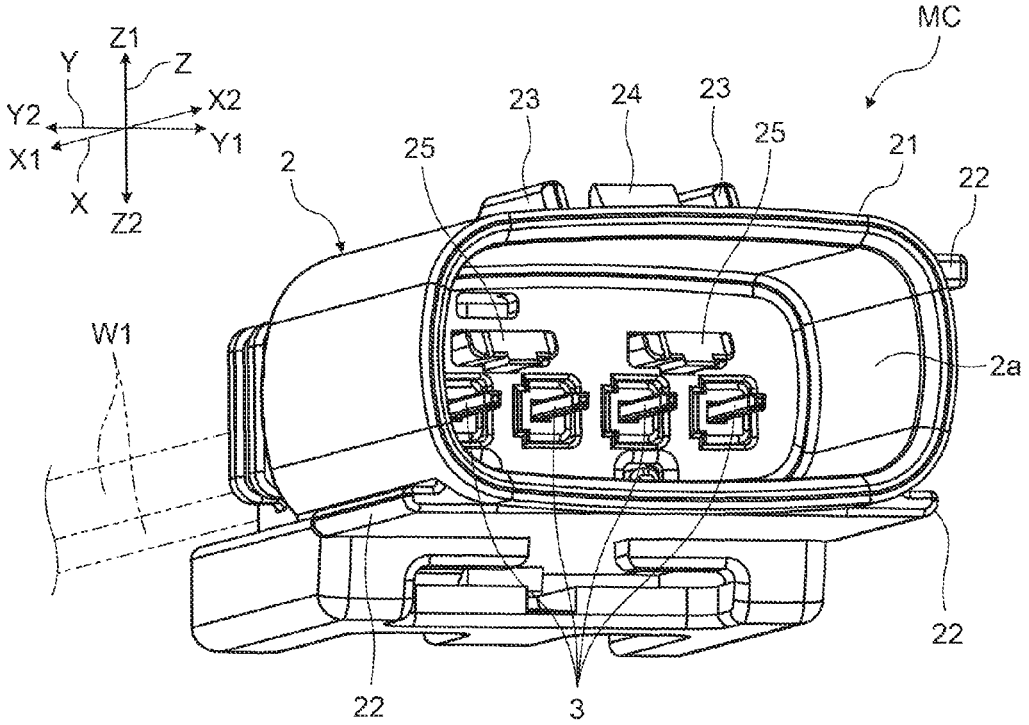
FIG. 3 is a perspective view of a male connector in the connector in the embodiment.
Figure 4:
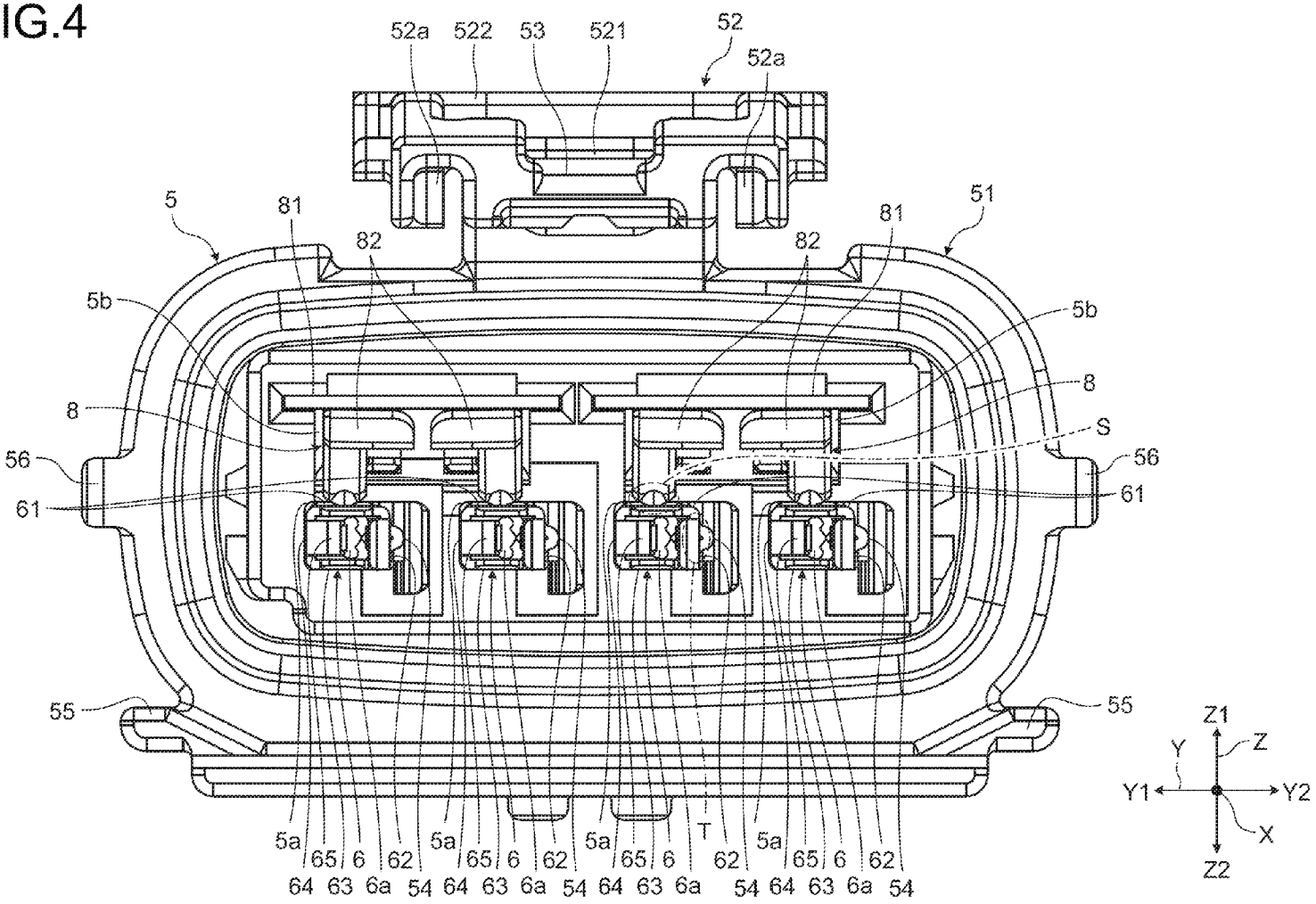
FIG. 4 is a front view of the female connector in the connector in the embodiment.
Figure 5:
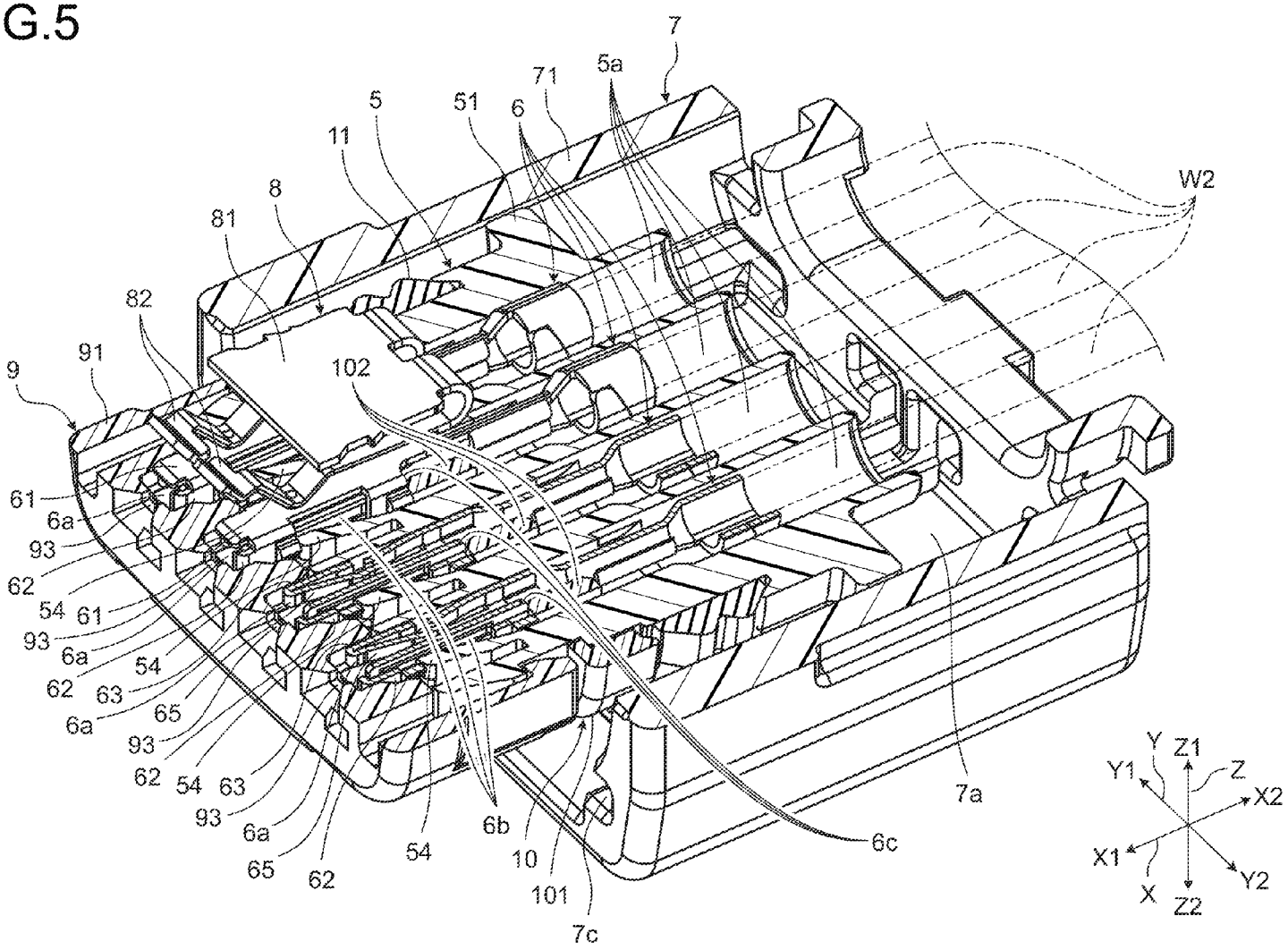
FIG. 5 is a cross-sectional perspective view illustrating a main part of the female connector in the connector in the embodiment.
Figure 6:
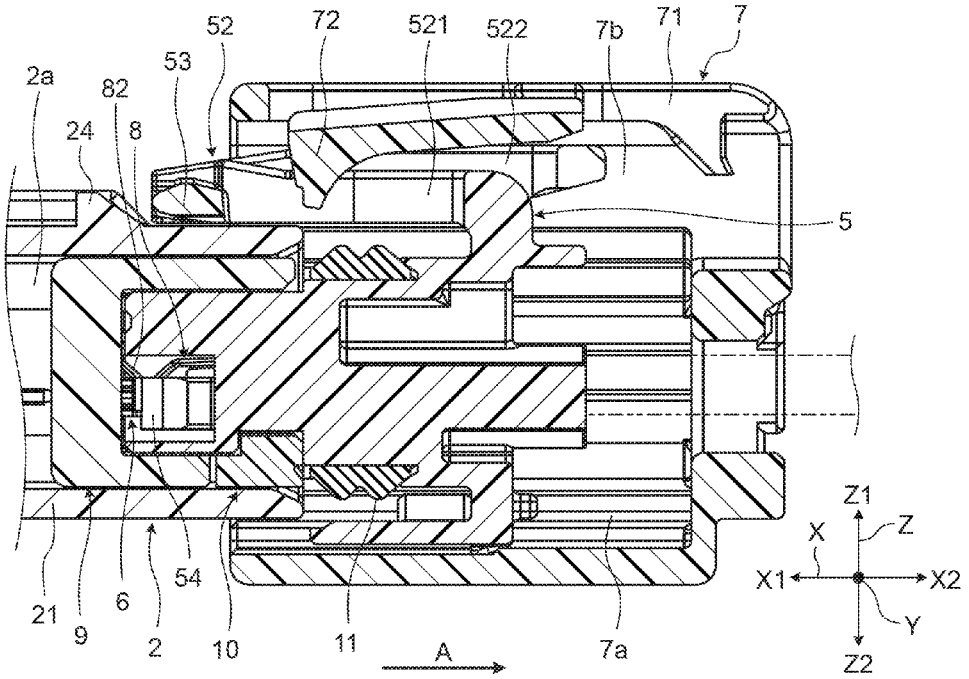
FIG. 6 is a descriptive view for explaining an operation of the connector in the embodiment.
Figure 7:
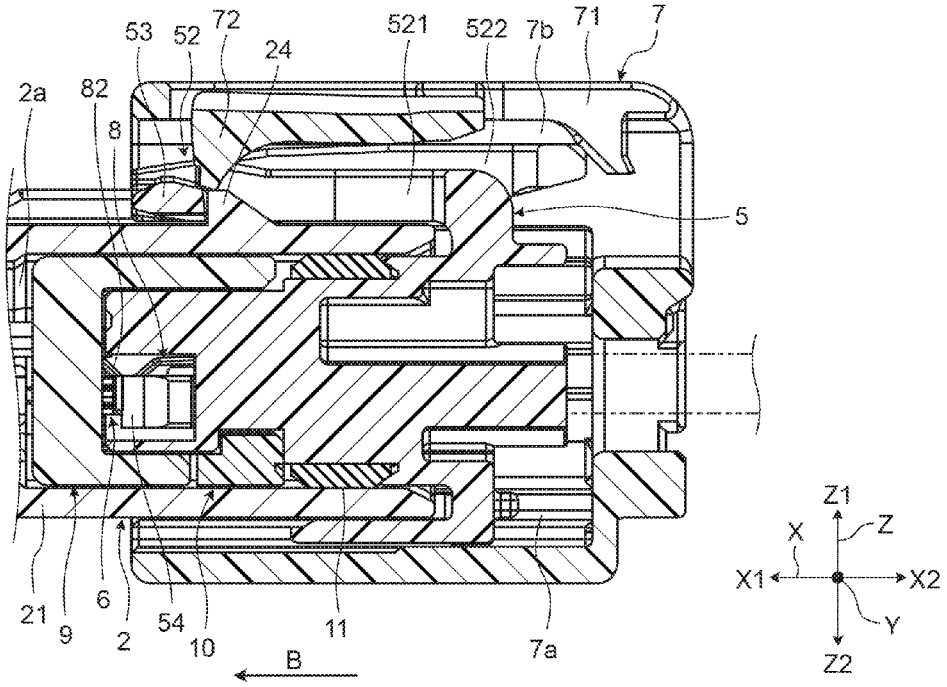
FIG. 7 is a descriptive view for explaining an operation of the connector in the embodiment.
Figure 8:
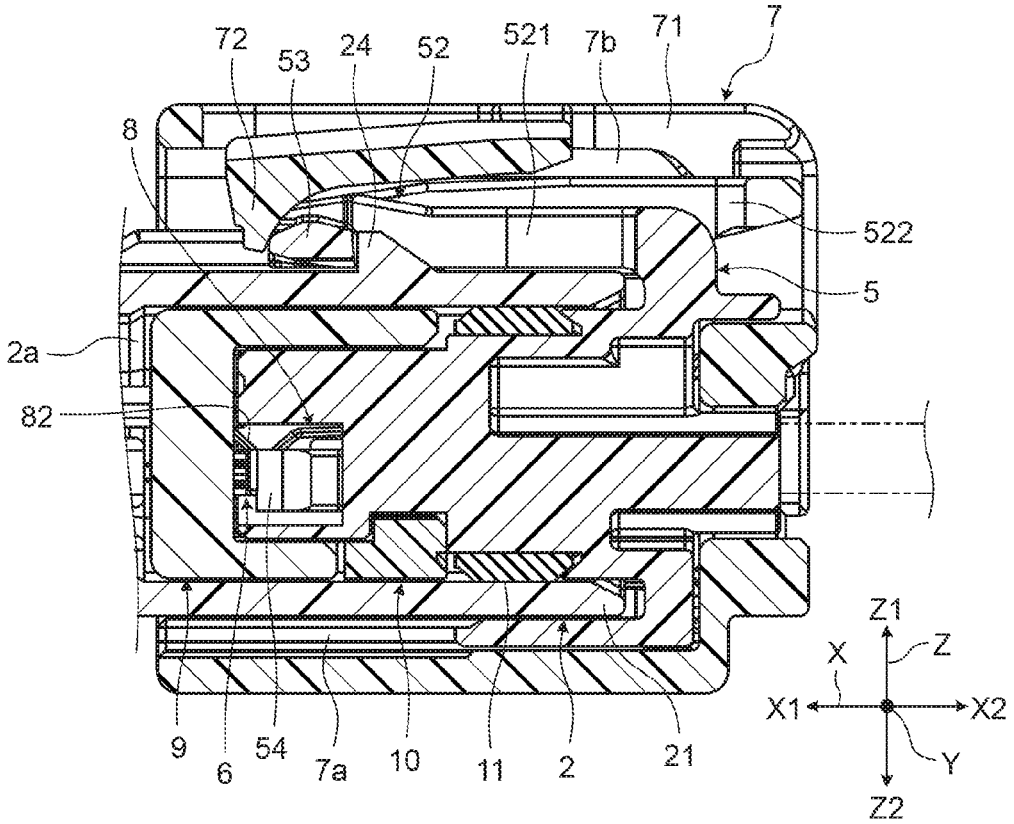
FIG. 8 is a descriptive view for explaining an operation of the connector in the embodiment.

FIG. 1 is an exploded perspective view of a connector according to an embodiment. FIG. 2 is an exploded perspective view of a female connector in the connector in the embodiment. FIG. 3 is a perspective view of a male connector in the connector in the embodiment. FIG. 4 is a front view of the female connector in the connector in the embodiment. FIG. 5 is a cross-sectional perspective view illustrating a main part of the female connector in the connector in the embodiment. FIG. 6 to FIG. 8 are descriptive views for explaining operations of the connector in the embodiment. FIG. 1 illustrates a state in which components configuring the male connector and the female connector are combined and FIG. 2 illustrates a state in which the components configuring the female connector are exploded. FIG. 1 to FIG. 3 and FIG. 5 to FIG. 8 illustrate some electric wires that are connected to terminals by two-dot chain lines. FIG. 6 illustrates a fitted state between a male housing and a female housing and a state in which a CPA member is located at an initial position. FIG. 8 illustrates a state in which the CPA member is located at a fitting assurance position. FIG. 6 to FIG. 8 partially illustrate parts of the male housing that includes a main body portion.

An X direction in FIG. 1 to FIG. 8 is a fitting direction of a connector 1 in the embodiment and is a front-rear direction of a male connector MC and a female connector FC. A Y direction is an alignment direction of the connector 1 in the embodiment, is a direction orthogonal to the fitting direction, and is a width direction of the male connector MC and the female connector FC. A Z direction is an up-down direction of the connector 1 in the embodiment, and is a direction orthogonal to the fitting direction and the alignment direction. An X1 direction is a male direction of the connector 1 and an X2 direction is a female direction of the connector 1. A Y1 direction is a leftward direction of the connector 1 and a Y2 direction is a rightward direction of the connector 1. A Z1 direction is an upward direction of the connector 1 and a Z2 direction is a downward direction of the connector 1. The respective directions that are used in the following description indicate directions in a state in which respective components are assembled to one another unless otherwise particularly specified.

The connector 1 in the embodiment illustrated in FIG. 1 is applied to, for example, a wire harness WH that is used for vehicles and the like. The connector 1 is a connection mechanism for wire-to-wire connection that connects electric wires W1 and electric wires W2 configuring the wire harness WH, and is used in, for example, an airbag circuit. The electric wires W1 and W2 include, for example, conducting portions (core wires) formed by twisting a plurality of conductive metal strands and insulating coating portions coating the outer sides of the conducting portions. The connector 1 includes the male connector MC and the female connector FC. When the male connector MC and the female connector FC are fitted to each other for connector junction, male terminals 3 and female terminals 6 that are included in the male connector MC and the female connector FC, respectively, are electrically connected to each other and electric connection sites are formed therebetween, as illustrated in FIG. 1 to FIG. 3. The electric wires W1 and W2 are connected to the male terminals 3 and the female terminals 6, respectively, and waterproof members (not illustrated) are interposed between the outer circumferences of the electric wires W1 and W2 and terminal insertion chambers of a male housing 2 and terminal insertion chambers 5*a* of a female housing 5, which will be described later, to ensure waterproof performance.

The male connector MC is a male type connector that is connected to ends of the electric wires W1 configuring the wire harness WH as illustrated in FIG. 1 and FIG. 3. The male connector MC includes the male housing 2 and the male terminals 3.

The male housing 2 is a first housing, is a male-side connector housing, and is formed with an insulting synthetic resin material or the like. The male housing 2 is provided with the male terminals 3 and includes a main body portion 21, first ribs 22, second ribs 23, a male beak 24, and short-circuit cancellation portions 25.

The main body portion 21 is formed into a substantially long cylindrical shape that is closed at the male direction side along the fitting direction and a fitting space portion 2*a* is formed in the main body portion 21. The fitting space portion 2*a* is a space portion that communicates with the outside through an opening formed in an end portion of the main body portion 21 at the female direction side and into which the female housing 5, which will be described later, of the female connector FC is fitted. The main body portion 21 holds the male terminals 3 such that front end portions of the male terminals 3 (end portions thereof at the female direction side) are exposed into the fitting space portion 2*a*.

The first ribs 22 are formed so as to project from the outer circumferential surface of the main body portion 21 and extend in the fitting direction. The first ribs 22 in the embodiment are formed on the outer circumferential surface of the main body portion 21, and are inserted into a plurality of support groove portions 7*c* of a CPA member 7, which will be described later, in connector fitting between the male connector MC and the female connector FC to support the CPA member 7 on the male housing 2.

The second ribs 23 are formed so as to project from the outer circumferential surface of the main body portion 21 and extend in the fitting direction. The second ribs 23 in the embodiment are formed on the outer circumferential surface of the main body portion 21, and are inserted into a plurality of support groove portions 52*a* of a lock arm portion 52, which will be described later, of the female housing 5 in the connector fitting to support a female lock portion 53, which will be described later, of the female housing 5 on the male housing 2.

The male beak 24 is a first locking portion and is formed so as to project from the outer circumferential surface of the main body portion 21. The male beak 24 in the embodiment is formed at a substantially center portion in the alignment direction and in the vicinity of an end portion on the female direction side in the fitting direction on the upward direction side surface of the outer circumferential surfaces of the main body portion 21. The surface of the male beak 24 on the female direction side out of the opposing surfaces thereof with the top interposed therebetween in the fitting direction is formed into an inclined surface projecting toward the male direction side whereas the surface of the male beak 24 at the male direction side is formed into a locking surface that is parallel (including substantially parallel) with the up-down direction. The male beak 24 is a portion for locking the female lock portion 53 of the female housing 5.

The short-circuit cancellation portions 25 cancel a short-circuit state of the female terminals 6 and short-circuiting pieces 8, which will be described later, in the fitted state to make them into a non-short-circuit state. The short-circuit cancellation portions 25 make the female terminals 6 and the short-circuiting pieces 8 into the non-short-circuit state by being inserted into between the female terminals 6 and the short-circuiting pieces 8 in the fitted state and cause the short-circuiting pieces 8 which has been in contact with the female terminals 6 in the short-circuit state to be separated from the female terminal 6. The short-circuit cancellation portions 25 in the embodiment are plate-like members projecting to the female direction side from the inner wall surface of the main body portion 21 that forms the end portion of the fitting space portion 2*a* at the male direction side, correspond to the respective short-circuiting pieces 8, and are formed and arranged in the alignment direction. The fitted state indicates a state in which the male housing 2 and the female housing 5 are fitted to each other, that is, a state in which the female housing 5 is fitted to the male housing 2 at an proper fitting position in the fitting space portion 2*a* of the male housing 2. In the fitted state, the female lock portion 53 is locked to the male beak 24 and the female terminals 6 and the male terminals 3 are electrically connected to each other properly.

The male terminals 3 are first terminals and are inserted into the female terminals 6 to be electrically connected to the female terminals 6. The male terminals 3 are aligned in the alignment direction in the male housing 2. The male terminals 3 are male type terminal metal fittings for a connector, and are connected to the ends of the electric wires W1. The male terminals 3 are each entirely made of conductive metal. The two male terminals 3 in the embodiment that are adjacent to each other in the alignment direction form a pair and two pairs of male terminals 3 extend along the fitting direction in a state of being held in the male housing 2. For example, end portions (end portions thereof at the male direction side) of the male terminals 3 at the opposite side to the front end portions thereof exposed into the fitting space portion 2*a* are held in terminal insertion chambers (cavities) (not illustrated), and the electric wires W1 are connected to the end portions of the male terminals 3 at the opposite side. The terminal insertion chambers are formed so as to extend in the fitting direction, end portions thereof on the female direction side communicate with the fitting space portion 2*a*, and the terminal insertion chambers communicate with the outside through openings formed in the end portion of the main body portion 21 at the male direction side. The male terminals 3 are inserted into the terminal insertion chambers along the fitting direction through the openings communicating with the terminal insertion chambers and formed in the end portion of the main body portion 21 at the male direction side and are locked with lances (not illustrated). With this insertion and locking, the male terminals 3 are held in the male housing 2 in a state in which the front end portions thereof are exposed into the fitting space portion 2*a* of the main body portion 21.

As illustrated in FIG. 1, FIG. 2, FIG. 4, and FIG. 5, the female connector FC is a female type connector that is connected to the ends of the electric wires W2 as second electric wires configuring the wire harness WH. The female connector FC includes the female housing 5, the female terminals 6, the CPA member 7, the short-circuiting pieces 8, a front holder 9, a side spacer 10, and a waterproof packing 11.

The female housing 5 is a second housing and a target housing in the embodiment, is a female-side connector housing, and is formed with an insulating synthetic resin material or the like. The female housing 5 is provided with the female terminals 6 and is inserted into the fitting space portion 2*a* of the male housing 2 to be fitted to the male housing 2. The female housing 5 includes a main body portion 51, the lock arm portion 52, the female lock portion 53, lances 54, ribs 55, and projections 56.

The main body portion 51 is a portion that is formed into a substantially long columnar shape along the fitting direction and is inserted into the fitting space portion 2*a* to be fitted into the male housing 2. The terminal insertion chambers 5*a* (cavities) and short-circuiting piece insertion chambers 5*b* are formed in the main body portion 51. The terminal insertion chambers 5*a* are space portions that are formed so as to extend in the fitting direction and communicate with the outside through openings formed in both of end portions of the main body portion 51 in the fitting direction. The female terminals 6 are inserted into the terminal insertion chambers 5*a* along the fitting direction and are held therein. The terminal insertion chambers 5*a* in the embodiment are formed and arranged in the alignment direction in the main body portion 51 in accordance with the number of female terminals 6 provided in the female housing 5. The terminal insertion chambers 5*a* communicate with the outside through openings formed in an end portion of the main body portion 51 at the downward direction side. The short-circuiting piece insertion chambers 5*b* are space portions that are formed so as to extend in the fitting direction and communicate with the outside through the openings formed in the end portion of the main body portion 51 at the male direction side. The short-circuiting pieces 8 are inserted into the short-circuiting piece insertion chambers 5*b* along the fitting direction and are held therein. The short-circuiting piece insertion chambers 5*b* in the embodiment are formed and arranged in the alignment direction in the main body portion 51 in accordance with the number of short-circuiting pieces 8 provided in the female housing 5. Each of the short-circuiting piece insertion chambers 5*b* communicates, in the up-down direction, with the terminal insertion chambers 5*a* holding therein the respective female terminals 6 with which one short-circuiting piece 8 makes electric contact.

The lock arm portion 52 supports the female lock portion 53 in a state in which the female lock portion 53 is spaced from the main body portion 51 in the up-down direction. The lock arm portion 52 includes a first arm portion 521 and a second arm portion 522. The first arm portion 521 is formed into a U shape opened to the male direction side when seen from the up-down direction. An end portion of the first arm portion 521 at the female direction side is coupled to the main body portion 51 and the female lock portion 53 is formed between both of end portions of the first arm portion 521 at the male direction side (two end portions in the width direction).

Accordingly, the first arm portion 521 support the female lock portion 53 such that the female lock portion 53 is movable in the up-down direction with respect to the main body portion 51 by elastically deforming in the up-down direction. The first arm portion 521 includes the support groove portions 52*a* that are formed in both of the end portions thereof at the male direction side along the fitting direction. The second arm portion 522 is formed into a U shape opened to the male direction side when seen from the up-down direction. Both of end portions of the second arm portion 522 at the male direction side (two end portions in the width direction) are coupled to both of the end portions of the first arm portion 521 at the male direction side. First projections 523, second projections 524, and third projections 525 are formed on both of the end portions of the second arm portion 522 in the width direction so as to project outward. The first to third projections 523 to 525 in the embodiment are inserted into a plurality of second restricting groove portions 7*e*, which will be described later, of the CPA member 7 in CPA insertion when the female housing 5 is inserted into the CPA member 7 to restrict a position of the CPA member 7 relative to the female housing 5 in the fitting direction.

The female lock portion 53 is a second locking portion and configures a locking mechanism for locking the female housing 5 to the male housing 2. The female lock portion 53 climbs over the male beak 24 to be locked to the male beak 24 in the fitting direction in the fitted state. The female lock portion 53 in the embodiment is formed on an end portion of the lock arm portion 52 at the male direction side. An end surface of the female lock portion 53 at the female direction side is formed as a locking surface that is parallel (including substantially parallel) with the up-down direction.

The lances 54 configure locking mechanisms and lock the female terminals 6 to the female housing 5. The lances 54 in the embodiment are inserted into locking holes 6*b*, which will be described later, of the female terminals 6 to restrict the movement of the female terminals 6 in the terminal insertion chambers 5*a* to the female direction side and lock the female terminals 6 in the terminal insertion chambers 5*a*. The lances 54 are formed in the respective terminal insertion chambers 5*a*. The lances 54 are formed so as to extend to the male direction side from one of the inner wall surfaces opposing each other in the alignment direction among the inner wall surfaces of the main body portion 51 that form the terminal insertion chambers 5*a* and project to the inner sides of the terminal insertion chambers 5*a* while being separated from the inner wall surfaces.

The ribs 55 are formed so as to project from the outer circumferential surface of the main body portion 51 and extend in the fitting direction. The ribs 55 in the embodiment are formed on the outer circumferential surface of the main body portion 51, and are inserted into the respective support groove portions 7*c*, which will be described later, of the CPA member 7 in the CPA insertion to support the CPA member 7 on the female housing 5.

The projections 56 are formed so as to project from the outer circumferential surface of the main body portion 51. The projections 56 in the embodiment are formed in a pair in the alignment direction on end portions of the outer circumferential surface of the main body portion 51 at the female direction side and center portions thereof in the up-down direction, and are inserted into a plurality of first restricting groove portions 7*d*, which will be described later, of the CPA member 7 in the CPA insertion to support the CPA member 7 on the female housing 5.

The female terminals 6 are second terminals and are target terminals in the embodiment. The female terminals 6 are electrically connected to the male terminals 3 by insertion of the male terminals 3 thereinto, and are aligned in the alignment direction in the female housing 5. The female terminals 6 are female type terminal metal fittings for a connector, and are connected to the ends of the electric wires W2. The female terminals 6 are each entirely made of conductive metal. The female terminals 6 in the embodiment that are adjacent to each other in the alignment direction form a pair and two pairs of female terminals 6 extend along the fitting direction in a state of being held in the female housing 5. Front end portions of the female terminals 6 oppose the front holder 9 in the fitting direction and the electric wires W2 are connected to end portions (end portions at the female direction side) of the female terminals 6 at the opposite side to the front end portions. The female terminals 6 are inserted into the terminal insertion chambers 5*a* through an opening formed in the end portion of the main body portion 51 at the female direction side along the fitting direction and locked with the lances 54 to be held in the female housing 5. The female terminals 6 have therein insertion space portions 6*a*. The insertion space portions 6*a* are space portions that are formed so as to extend in the fitting direction and communicate with the outside through openings formed in the female terminals 6 at the male direction side. The front end portions of the male terminals 3 are inserted into the insertion space portions 6*a* along the fitting direction and are held therein.

The female terminals 6 have a plurality of outer circumferential surfaces when seen from the fitting direction. The female terminals 6 in the embodiment are formed by folding one metal plate material and are formed into rectangular shapes. That is to say, the female terminals 6 have, as the outer circumferential surfaces, first outer circumferential surfaces 61 and third outer circumferential surface 63 as pairs of longer sides and second outer circumferential surfaces 62 and fourth outer circumferential surfaces 64 as pairs of shorter sides. The first outer circumferential surfaces 61 and the third outer circumferential surfaces 63 oppose each other in the up-down direction and the second outer circumferential surfaces 62 and the fourth outer circumferential surfaces 64 oppose each other in the alignment direction in a state in which the female terminals 6 are held in the terminal insertion chambers 5*a*. The first outer circumferential surfaces 61 configure short circuit mechanisms. The first outer circumferential surfaces 61 are surfaces of the outer circumferential surfaces that are located at the upward direction side, are substantially flat surfaces with less irregularities, and also serve as terminal contact surfaces with which the short-circuiting pieces 8 make contact. The second outer circumferential surfaces 62 are surfaces of the outer circumferential surfaces that are located at the rightward direction side, and also serve as lance and spacer locking surfaces. The second outer circumferential surfaces 62 have the locking holes 6*b* and spacer lock portions 6*c*. The locking holes 6*b* configure the locking mechanisms. The locking holes 6*b* are holes into which the lances 54 are inserted, and are formed by cutting out parts of the second outer circumferential surfaces 62. The spacer lock portions 6*c* are locking surfaces to which a part of the side spacer 10 is locked and are formed by cutting out parts of the second outer circumferential surfaces 62 on the female direction side relative to the locking holes 6*b*. The third outer circumferential surfaces 63 are surfaces of the outer circumferential surfaces that are located at the downward direction side and are substantially flat surfaces with less irregularities. The fourth outer circumferential surfaces 64 are surfaces of the outer circumferential surfaces that are located at the leftward direction side and serve as spring piece formation surfaces on which spring pieces 65 are formed. The spring pieces 65 make electrical contact with the male terminals 3 the front end portions of which are inserted into the insertion space portions 6*a*, and are formed so as to extend to the female direction side in the insertion space portions 6*a* from end portions of the fourth outer circumferential surfaces 64 at the male direction side. The spring pieces 65 are formed in an elastically deformable manner while front end portions thereof as end portions at the female direction side are separated from the inner wall surfaces corresponding to the fourth outer circumferential surface 64.

The CPA member 7 is a member for detecting complete fitting between the male housing 2 and the female housing 5 and serves as a member for achieving what-is-called connector position assurance (CPA). The CPA member 7 covers the outer side of the female housing 5 and is assembled to the female housing 5 so as to be movable in the fitting direction relative to the female housing 5. The CPA member 7 is formed with an insulating synthetic resin material or the like and includes a main body portion 71 and a CPA lock portion 72.

The main body portion 71 is formed into a substantially rectangular columnar shape along the fitting direction and a holding chamber 7*a* and an arm portion insertion chamber 7*b* are formed in the main body portion 71. The holding chamber 7*a* is a space portion that is formed so as to extend in the fitting direction and communicates with the outside through an opening formed in an end portion of the main body portion 71 at the male direction side. The female housing 5 is inserted into the holding chamber 7*a* along the fitting direction and is held therein. The arm portion insertion chamber 7*b* is formed so as to extend in the fitting direction and the CPA lock portion 72 is located in the arm portion insertion chamber 7*b*. The arm portion insertion chamber 7*b* is a space portion that communicates with the outside through the opening formed in the end portion of the main body portion 71 at the male direction side. The lock arm portion 52 and the female lock portion 53 are inserted into the arm portion insertion chamber 7*b* along the fitting direction and the female lock portion 53 locked to the male beak 24 is further locked with the CPA lock portion 72 in the arm portion insertion chamber 7*b*. The arm portion insertion chamber 7*b* communicates with the holding chamber 7*a* in the up-down direction and communicates with the outside through an opening formed in an end portion of the main body portion 71 on the upward direction side. The main body portion 71 includes the support groove portions 7*c*, the first restricting groove portions 7*d*, and the second restricting groove portions 7*e*. The support groove portions 7*c* are formed along the extension direction in the holding chamber 7*a* and are formed so as to correspond to the sets of first ribs 22 and the sets of ribs 55. The first restricting groove portions 7*d* are formed along the extension direction in the holding chamber 7*a* and a pair thereof are formed in the alignment direction so as to correspond to the pair of projections 56. The first restricting groove portions 7*d* have restricting projections 73 halfway that are formed toward the inner side of the holding chamber 7*a* from the bottom surface. The restricting projections 73 prevent detachment of the CPA member 7 from the female housing 5 due to the movement of the CPA member 7 to the male direction side relative to the female housing 5 when the projections 56 inserted into the first restricting groove portions 7*d* climb over the restricting projections 73. The second restricting groove portions 7*e* are formed along the extension direction in the arm portion insertion chamber 7*b* and are formed so as to correspond to the sets of first to third projections 523 to 525. The second restricting groove portions 7*e* have restricting projections (not illustrated) halfway that are formed toward the downward direction to the inner side of the holding chamber 7*a* from the bottom surfaces. The restricting projections are located between the first projections 523 and the second projections 524 in the fitting direction when the first projections 523 inserted into the second restricting groove portions 7*e* climb over the restricting projections and restrict the movement of the CPA member 7 in the fitting direction relative to the female housing 5 at the fitting assurance position of the CPA member 7. It should be noted that the main body portion 71 has an opening formed in an end portion at the female direction side for enabling the female terminals 6 and the electric wire W2 to be inserted into the holding chamber 7*a*.

The CPA lock portion 72 is a third locking portion and configures a locking mechanism for locking the CPA member 7 to the female housing 5. The CPA lock portion 72 climbs over, in order, the male beak 24 and the female lock portion 53 locked to the male beak 24 to be locked to the female lock portion 53 at the fitting assurance position with the movement of the CPA member 7 to the fitting assurance position from the initial position relative to the female housing 5 in the fitted state. The CPA lock portion 72 in the embodiment is formed into a substantially rectangular columnar shape and is formed so as to extend toward the arm portion insertion chamber 7*b*. The CPA lock portion 72 is supported on the main body portion 71 in a cantilever manner while an end portion thereof at the female direction side is coupled to the main body portion 71 and a front end portion thereof as an end portion at the male direction side is formed as a free end. The CPA lock portion 72 is formed such that the front end portion projects downward.

The short-circuiting pieces 8 configure the short circuit mechanisms, and short-circuit the female terminals 6 that are aligned in the female housing 5 and are adjacent in the alignment direction in the non-fitted state in which the male housing 2 and the female housing 5 are not fitted to each other. The short-circuiting pieces 8 are each entirely made of conductive metal. The short-circuiting pieces 8 in the embodiment are formed so as to correspond to the pairs of female terminals 6. Each short-circuiting piece 8 suppresses difference in potential between one pair of female terminals 6 by electric contact with the pair of female terminals 6. The short-circuiting pieces 8 include main body portions 81 and arm portions 82.

The main body portions 81 are flat plate-like members along a plane containing the fitting direction and the alignment direction and are inserted into the short-circuiting piece insertion chambers 5*b* to be held in the main body portion 51. With this insertion and holding, the movement of the main body portions 81 in the up-down direction, the fitting direction, and the alignment direction relative to the main body portion 51 is restricted. The arm portions 82 are coupled to end portions of the main body portions 81 at the female direction side.

The arm portions 82 make electrical contact with one pairs of female terminals 6 and are plate-like members. The arm portions 82 in the embodiment are formed in a pair for each main body portion 81 so as to correspond to the respective female terminals 6 of each pair of female terminals 6. End portions of the arm portions 82 at the female direction side are coupled to the main body portions 81 and are formed so as to be folded back to the male direction side. That is to say, front end portions of the arm portions 82 (end portions thereof on the male direction side) oppose end portions of the main body portions 81 on the male direction side in the up-down direction. The arm portions 82 have contact portions halfway in the fitting direction that project downward and make contact with the female terminals 6.

The front holder 9 is mounted on an end portion of the female housing 5 at the male direction side and covers the end portion of the main body portion 51 at the male direction side. The front holder 9 has a main body portion 91 and openings 92 and 93. The main body portion 91 is formed into a substantially rectangular cylindrical shape that is closed at the male direction side along the fitting direction and has therein an insertion space portion 9*a* into which the end portion of the main body portion 51 on the male direction side is inserted. The female housing 5 is inserted into the main body portion 91 and the main body portion 91 is held by the female housing 5. The openings 92 enable the short-circuit cancellation portions 25 to be inserted into the short-circuiting piece insertion chambers 5*b* and are formed so as to oppose the respective short-circuiting piece insertion chambers 5*b* in the fitting direction. The openings 93 enable the male terminals 3 to be inserted into the terminal insertion chambers 5*a* and are formed so as to oppose the respective terminal insertion chambers 5*a* in the fitting direction.

The side spacer 10 is a member for ensuring proper terminal holding force in order to hold the female terminals 6 in the terminal insertion chambers 5*a*. A part of the side spacer 10 in the embodiment is inserted into the terminal insertion chambers 5*a* from the downward direction side of the female housing 5. The side spacer 10 includes a main body portion 101 and locking projections 102. The main body portion 101 is formed into a U shape opened to the upward direction side when seen from the fitting direction. Both of end portions of the main body portion 101 on the upward direction side (two end portions in the alignment direction) are held by the main body portion 51 at the outside of the main body portion 51. The locking projections 102 are inserted into the terminal insertion chambers 5*a* to be inserted into the spacer lock portions 6*c* of the female terminals 6, and are formed so as to correspond to the respective female terminals 6. The locking projections 102 are formed between both of the end portions on the upward direction side and projecting upward.

The waterproof packing 11 is interposed in a space between the male housing 2 and the female housing 5 in the fitted state to prevent liquid such as water from entering the fitting space portion 2*a* from the outside. The waterproof packing 11 is formed into a ring shape and the main body portion 51 of the female housing 5 is inserted into an insertion space portion lie formed in the waterproof packing 11 along the fitting direction.

Next, assembly, that is, fitting of the connector 1 will be described. First, the assembly of the male connector MC is described. The male terminals 3 to which the electric wires W1 have been connected are inserted into the respective terminal insertion chambers through the openings formed in the end portion of the main body portion 21 at the male direction side. The inserted male terminals 3 are locked with the lances and are held in the male housing 2, thereby assembling the respective male terminals 3 on the male housing 2.

Next, assembly of the female connector FC is described. First, the short-circuiting pieces 8 are inserted into the respective short-circuiting piece insertion chambers 5*b* of the female housing 5 and are held in the respective short-circuiting piece insertion chambers 5*b*, thereby assembling the short-circuiting pieces 8 in the female housing 5. In this case, the respective arm portions 82 are located such that parts thereof project into the corresponding terminal insertion chambers 5*a*. Then, the waterproof packing 11 is inserted onto the main body portion 51 from the end portion thereof on the male direction side and is held on the main body portion 51, thereby assembling the waterproof packing 11 on the female housing 5. Subsequently, the side spacer 10 is held at a temporary position relative to the female housing 5. The main body portion 51 is inserted into between both of the end portions of the side spacer 10 at the upward direction side and the side spacer 10 is held by the main body portion 51 at the temporary position at which the locking projections 102 do not project into the terminal insertion chambers 5*a*. Then, the main body portion 51 is inserted into the insertion space portion 9*a* of the front holder 9 from the end portion thereof on the male direction side and the front holder 9 is held on the male direction side of the main body portion 51, thereby assembling the front holder 9 on the female housing 5.

Thereafter, the female housing 5 is inserted into the CPA member 7 from the end portion thereof on the female direction side, thereby assembling the CPA member 7 to the female housing 5. The main body portion 51 of the female housing 5 is inserted into the holding chamber 7*a* and the lock arm portion 52 and the female lock portion 53 are inserted into the arm portion insertion chamber 7*b* in the CPA insertion. In this case, the ribs 55 are inserted into the respective support groove portions 7*c*, the projections 56 are inserted into the respective first restricting groove portions 7*d*, and the first to third projections 523 to 525 are inserted into the respective second restricting groove portions 7*e*. When the female housing 5 is further moved to the female direction side relative to the CPA member 7, the projections 56 climb over the restricting projections 73 and the CPA member 7 is therefore assembled to the female housing 5 in a state of being movable between the initial position and the fitting assurance position.

Then, the female terminals 6 to which the electric wires W2 have been connected are inserted into the respective terminal insertion chambers 5*a* through the opening formed in the end portion of the main body portion 51 on the female direction side and the lances 54 are inserted into the respective locking holes 6*b* of the inserted female terminals 6. The lances 54 lock the respective female terminals 6 and the respective female terminals 6 are held in the female housing 5, thereby assembling the respective female terminals 6 to the female housing 5. In this case, the arm portions 82 of the respective short-circuiting pieces 8 make contact with the first outer circumferential surfaces 61 of the corresponding female terminals 6 in a state of being elastically deformed to the upward direction side and the pairs of female terminals 6 are made into the short-circuit state. As illustrated in FIG. 4, contact positions S between the female terminals 6 and the short-circuiting pieces 8 and locking positions T at which the female terminals 6 are locked to the female housing 5, that is, the female terminals 6 are locked with the lances 54, are different from each other about the fitting direction (about an axis while the fitting direction is set to the axis) when viewed from the fitting direction. In the connector 1 in the embodiment, the contact positions S and the locking positions T are located on different outer circumferential surfaces among the outer circumferential surfaces 61 to 64 of the female terminals 6. To be specific, the contact positions S are located on the first outer circumferential surfaces 61 as one outer circumferential surfaces of the outer circumferential surfaces 61 and 63 of the longer sides opposing each other in the up-down direction and the locking positions T are located on the second outer circumferential surfaces 62 as one outer circumferential surfaces of the outer circumferential surfaces 62 and 64 of the shorter sides opposing each other in the alignment direction.

Then, the side spacer 10 held at the temporary position is held at a final position at which the locking projections 102 project into the terminal insertion chambers 5*a*, thereby assembling the side spacer 10 on the female housing 5. In this case, the respective locking projections 102 are locked to the spacer lock portions 6*c* of the female terminals 6, and the respective female terminals 6 are locked at positions at which proper electric connection between the female terminals 6 and the male terminals 3 is ensured in the terminal insertion chambers 5*a*. In the embodiment, the movement of the female terminals 6 in the fitting direction is restricted by two sites of the lances 54 and the spacer lock portions 6*c* and the female terminals 6 are locked.

Next, the male connector MC is assembled to the female connector FC. First, as illustrated in FIG. 6, the female housing 5 is inserted into the fitting space portion 2*a* of the male housing 2 in a state in which the CPA member 7 is located at the initial position. When the female housing 5 starts being inserted into the fitting space portion 2*a*, the female housing 5 is inserted into the fitting space portion 2*a* and the CPA member 7 moves toward the fitting assurance position from the initial position in the fitting direction, that is, the CPA member 7 moves to the male direction side relative to the female housing 5. Then, the female housing 5 is further inserted into the fitting space portion 2*a* in a state in which the CPA lock portion 72 makes contact with the female lock portion 53 in the fitting direction and the movement of the CPA member 7 to the male direction side relative to the female housing 5 is restricted. Subsequently, as illustrated in FIG. 7, when the female lock portion 53 climbs over the male beak 24 to the male direction side and the male housing 2 and the female housing 5 are made into the fitted state, the climbed male beak 24 makes contact with the CPA lock portion 72 and pushes the CPA lock portion 72 to the upward direction. Thereafter, as illustrated in FIG. 8, when the CPA lock portion 72 climbs over the female lock portion 53 to the male direction side and the CPA member 7 is located at the fitting assurance position, the CPA lock portion 72 is located at the male direction side and the male beak 24 is located at the female direction side with the female lock portion 53 interposed therebetween, thereby making the connector 1 into the fitting assurance state.

With the connector 1 described above, the contact positions S and the locking positions T are different from each other about the fitting direction to prevent the contact positions S and the locking positions T from being located at the same positions when viewed from the fitting direction. That is to say, the short circuit mechanisms configured by the first outer circumferential surfaces 61 of the female terminals 6 and the short-circuiting pieces 8 and the locking mechanisms configured by the second outer circumferential surfaces 62 of the female terminals 6 and the lances 54 are not located at the same positions when viewed from the fitting direction. This positional relation can prevent one of the short circuit mechanisms and the locking mechanisms from influencing the other thereof.

The contact positions S and the locking positions T are not located on the same outer circumferential surfaces because, for example, the contact positions S and the locking positions T are located on the outer circumferential surfaces 61 and 62 that are different from each other, respectively. Accordingly, the locking holes 6*b* into which the lances 54 are inserted are not formed in the first outer circumferential surfaces 61 with which the arm portions 82 of the short-circuiting pieces 8 make contact. The contact positions with the first outer circumferential surfaces 61 can therefore be set freely without receiving restriction by the locking holes 6*b*. The contact areas of the short-circuiting pieces 8 with the female terminals 6, in particular, the contact areas in the fitting direction can be enlarged, thereby improving the contact performance of the short-circuiting pieces 8 to the female terminals 6. Furthermore, the arm portions 82 of the short-circuiting pieces 8 do not make contact with the second outer circumferential surfaces 62 having the locking holes 6*b* into which the lances 54 are inserted. The locking positions to the second outer circumferential surfaces 62, that is, forming positions of the locking holes 6*b* can therefore be set freely without receiving restriction by the positions at which the short-circuiting pieces 8 make contact with the female terminals 6. Accordingly, the shapes of the locking holes 6*b* are formed such that the locking states of the lances 54 for the female terminals 6 can be made preferable, in particular in terms of improvement in the locking force of the locking holes 6*b*.

Furthermore, the contact positions S are located on the first outer circumferential surfaces 61 of the longer sides that are parallel with the alignment direction and the locking positions T are located on the second outer circumferential surfaces 62 of the shorter sides that are parallel with the up-down direction. The respective female terminals 6 are therefore aligned horizontally in the alignment direction when viewed from the fitting direction. Accordingly, the length of the connector 1 in the up-down direction, that is, the height thereof can be reduced in comparison with the case in which the female terminals 6 are aligned longitudinally, to be specific, the outer circumferential surfaces 61 and 63 of the longer sides are parallel with the up-down direction and the outer circumferential surfaces 62 and 64 of the shorter sides are parallel with the alignment direction. Moreover, the lances 54 can be formed so as to oppose the female terminals 6 in the alignment direction unlike the case in which the female terminals 6 are aligned longitudinally and the short-circuiting pieces 8 and the lances 54 oppose each other with the female terminals 6 interposed therebetween in the up-down direction. Accordingly, the length of the connector 1 in the up-down direction, that is, the height thereof can be reduced for the thickness of the lances 54 and the amount of elastic deformation of the lances 54. The connector 1 can therefore be reduced in height.

The locking positions T are located on the second outer circumferential surfaces 62 of the shorter sides that are parallel with the up-down direction, thereby preventing the lances 54 from being exposed to the outside of the female housing 5 unlike the case in which the lances 54 are formed at lower positions relative to the female terminals 6. Accordingly, external force can be prevented from being applied to the lances 54 to protect the lances 54.

The contact positions S are located on the first outer circumferential surfaces 61 of the longer sides that are parallel with the alignment direction. The contact areas of the short-circuiting pieces 8 with the female terminals 6, in particular, the contact area in the alignment direction can be enlarged in comparison with the case in which the contact positions S are located on the outer circumferential surfaces 62 or 64 of the shorter sides, thereby improving the contact performance of the short-circuiting pieces 8 to the female terminals 6. Furthermore, the first outer circumferential surfaces 61 on which the contact positions S are located are formed by substantially flat surfaces with less irregularities, thereby easily ensuring the contact areas.

Although it is difficult to ensure the contact areas of the short-circuiting pieces 8 with the terminals because the configurations of the female terminals 6 are more complicated than the male terminals 3, the contact areas of the short-circuiting pieces 8 with the terminals can be ensured because the contact positions S can be located on the first outer circumferential surfaces 61 of the longer sides that are different from the second outer circumferential surfaces 62 of the shorter sides on which the locking positions T are located. Accordingly, the short-circuit state can be easily achieved by the female terminal 6.

As described above, with the connector 1, the positional relation between the short circuit mechanisms and the locking mechanisms can be made appropriate.

In the embodiment, the spring pieces 65 are provided on the fourth outer circumferential surfaces 64 of the shorter sides and can therefore be formed so as to oppose the female terminals 6 in the alignment direction unlike the case in which the short-circuiting pieces 8 and the spring pieces 65 are aligned in the up-down direction. Accordingly, the length of the connector 1 in the up-down direction, that is, the height thereof can be reduced for the thickness of the spring pieces 65 and the amount of elastic deformation of the spring pieces 65. The connector 1 can therefore be further reduced in height.

Although the contact positions S are located on the first outer circumferential surfaces 61 and the locking positions T are located on the second outer circumferential surfaces 62 in the above-mentioned embodiment, the invention is not limited thereto and the contact positions S may be located on the third outer circumferential surfaces 63 and the locking positions T may be located on the fourth outer circumferential surfaces 64. When the locking positions T are located on the fourth outer circumferential surfaces 64, the spring pieces 65 are preferably formed on the second outer circumferential surfaces 62.

Although the contact positions S and the locking positions T correspond to the female terminals 6 in the above-mentioned embodiment, the invention is not limited thereto and they may correspond to the male terminals 3. That is to say, the short-circuiting pieces 8 may be provided in the male housing 2, and the contact positions S between the male terminals 3 and the short-circuiting pieces 8 and the locking positions T at which the male terminals 3 are locked in the male housing 2 may be different from each other about the fitting direction when viewed from the fitting direction.

In the connector according to the embodiment, the contact positions between the target terminals and the short-circuiting pieces and the locking positions at which the target terminals are locked in the target housing are different from each other about the fitting direction when viewed from the fitting direction to prevent the contact positions and the locking positions from being located at the same positions when viewed from the fitting direction. Accordingly, the short circuit mechanisms for short-circuiting the adjacent target terminals and the locking mechanisms for locking the target terminals in the target housing are not located at the same positions when viewed from the fitting direction, thereby suppressing one of the short circuit mechanisms and the locking mechanisms from influencing the other thereof. Accordingly, an advantageous effect that the positional relation between the respective mechanisms can be made appropriate is provided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a first housing including a first locking portion, the first locking portion being formed so as to project from an outer surface of the first housing;

a plurality of first terminals aligned in an alignment direction in the first housing;

a second housing including a second locking portion, the second locking portion being configured to climb over the first locking portion to be locked to the first locking portion in a fitted state in which the second housing is fitted to the first housing;

a plurality of second terminals aligned in the alignment direction in the second housing, the second terminals being connected to the respective first terminals in the fitted state;

a fitting detection member includes a third locking portion and is configured to be assembled to the second housing and be allowed to move to a fitting assurance position from an initial position in a state in which the second locking portion is locked to the first locking portion, the third locking portion being configured to climb over the first locking portion and the second locking portion locked to the first locking portion in order with movement to the fitting assurance position from the initial position to be locked to the second locking portion at the fitting assurance position; and a short-circuiting piece that is provided in one target housing out of the first housing and the second housing and configured to short-circuit adjacent target terminals in the one target housing in a non-fitted state in which the first housing and the second housing are not fitted to each other, wherein contact positions between the target terminals and the short-circuiting piece and locking positions at which the target terminals are locked in the target housing are different from each other about a fitting direction between the first housing and the second housing when viewed from the fitting direction.

2. The connector according to claim 1, wherein the target terminals have a plurality of outer circumferential surfaces when viewed from the fitting direction, and the contact positions and the locking positions are located on different surfaces out of the plurality of outer circumferential surfaces.

3. The connector according to claim 2, wherein the target terminals are formed into rectangular shapes when viewed from the fitting direction, the outer circumferential surface on which the locking positions are located is one of the outer circumferential surfaces of shorter sides opposing each other in the alignment direction, and the outer circumferential surface on which the contact positions are located is one of the outer circumferential surfaces of longer sides opposing each other in an up-down direction orthogonal to the alignment direction.

* * * * *